US006785939B1

(12) United States Patent
James

(10) Patent No.: US 6,785,939 B1
(45) Date of Patent: Sep. 7, 2004

(54) DECORATIVE URN FOR USE AS A LIGHTED MEMORIAL

(76) Inventor: Phyllis James, 8711 E. Pinnacle Peak Rd., #270, Scottsdale, AZ (US) 85255

( * ) Notice: Subject to any disclaimer, the term of this patent is extended or adjusted under 35 U.S.C. 154(b) by 0 days.

(21) Appl. No.: 10/670,088

(22) Filed: Sep. 23, 2003

Related U.S. Application Data

(60) Provisional application No. 60/413,813, filed on Sep. 25, 2002.

(51) Int. Cl.[7] ..... A61G 17/00
(52) U.S. Cl. ..... 27/1; 362/161; 431/298
(58) Field of Search ..... 27/1; D99/5; 431/289, 431/291, 298, 319, 320; 362/161

(56) References Cited

U.S. PATENT DOCUMENTS 5,613,760 A * 3/1997 Dunn ..... 362/161
5,813,098 A * 9/1998 Schneider ..... 27/1
6,347,879 B1 * 2/2002 Prado ..... 362/159
6,520,606 B1 * 2/2003 Robinson ..... 312/111
2001/0033488 A1 * 10/2001 Chliwnyj et al. ..... 362/231

* cited by examiner

*Primary Examiner*—William L. Miller
(74) *Attorney, Agent, or Firm*—Joseph H. Roediger; Gregory J. Nelson

(57) ABSTRACT

A decorative urn for storing cremation ashes in a lighted two part container. The base section receives an ash-containing receptacle and supported thereon is a top section including a recessed wick structure and full reservoir. The sections are light transmissive so that light from the wick imparts a glow throughout the urn.

5 Claims, 1 Drawing Sheet

DECORATIVE URN FOR USE AS A LIGHTED MEMORIAL

CROSS REFERENCE TO RELATED APPLICATION

The present invention is based on provisional patent application Serial No. 60/413,813 filed Sept. 25, 2002.

BACKGROUND OF THE INVENTION

This invention relates to a novel decorative urn for storing cremation ashes in a lighted memorial display.

The devotion of a long term pet to its owner has created a corresponding interest in providing a suitable and tasteful way of keeping the memory of the departed pet fresh in the mind of the owner. While the display of a photograph serves as a reminder, it is generally limited in evoking a memory beyond that of the particular scene portrayed. A static display, such as a photograph or an artifact associated with a particular event, lacks the emotional impact of a memorial display containing the physical remains of the pet.

The retention of cremation ashes in the home environment is an ever increasing way of promoting the feeling in the owners that the pet is still with the spirit in the home. The coupling of a storage receptacle for the cremation ashes along with an active display of light is thought to broaden and enhance the impact of knowing that the remains of the pet rests therein. It is felt that the association of an active light, such as a flame, with a suitable display structure that magnifies the effect of the flame, not only draws attention to the urn but suggests life itself. As a result, the pet owner having the ashes included in an active display is continually reminded of an active pet and its activities throughout its life.

The present invention has as a significant object the use of a long-burning flame in combination with a receptacle for the ashes of a pet. A further object is the provision of a decorative urn that includes a partially-light transmissive surround. The surround has a glow imparted to it from the flame which magnifies the visual impact of the flame. A chamber is provided beneath the flame and fuel reservoir for receiving the contained ashes of the cremated pet. While the primary use for the urn is for the storage and memorialization of animals, it is to be noted that the device may be for the ashes of all animate or inanimate objects.

The subject decorative urn is a two section upright structure having a base section that is provided with a bottom surface to rest on a support such as a mantle or table. The top surface of the base section receives thereon a light-transmissive housing, which contains a fluid reservoir and the light generating flame. The housing is capable of independent use as a light source. The present invention is simple in form and attractive in appearance as befits the use for which it is intended.

SUMMARY OF THE INVENTION

The decorative urn which is the subject of this invention comprises a base section along with a housing to be supported thereon. The base section includes a cavity therein for removably receiving a receptacle dimensioned to be readily placed therein. The base section further includes a top surface that receives the housing containing a wick structure and a fluid reservoir. The base section and housing are flanged to provide engaging means for removably supporting the housing on the top surface of the base section. In the preferred embodiment, the assemblage of base section and housing thereon appear as a uniform cylinder to the observer.

The housing contains a centrally-located port which communicates with the fluid reservoir therein. A wick assembly is removably located in the port after the reservoir is filled. The wick extends into the fluid reservoir for drawing fuel therefrom and sustaining a lighted flame. The material of the housing is light-transmissive. A vertical flange extends around the periphery of the housing and aids in the glow imparted to the housing by the flame. If desired, an opaque material can be used to form the base section or, alternatively, an opaque shield can be used in the cavity in the base section so that the outline of the ash containing receptacle is not directly shown by the light transmitted through the material of the base section of the urn. Further features and advantages of the invention will become more readily apparent from the following detailed description of a specific embodiment when taken in conjunction of the accompanying drawings.

DESCRIPTION OF THE PREFERRED EMBODIMENT

Figure 1:
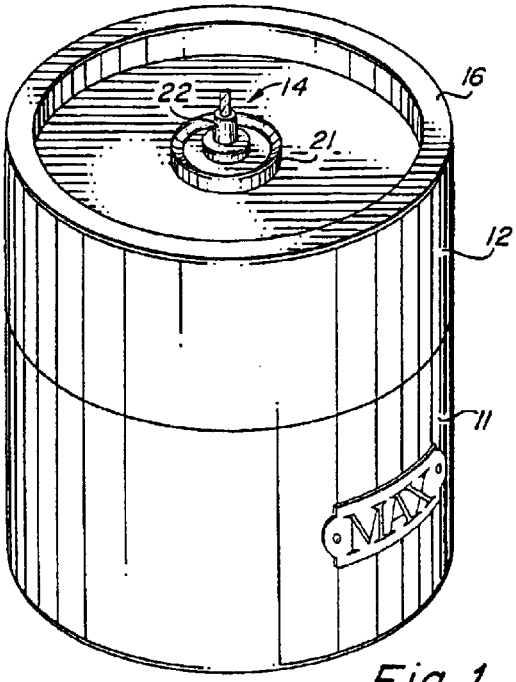
FIG. 1 is a view in perspective of one embodiment of the invention.
Figure 2:
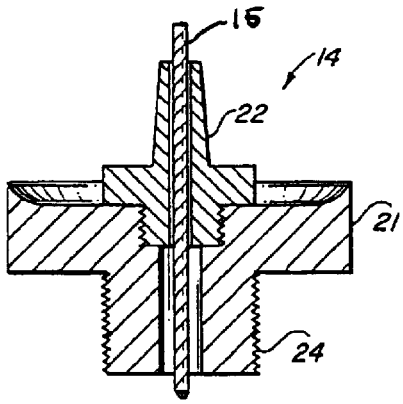
FIG. 2 is a cross sectional view of the wick assembly of the embodiment of FIG. 1.

Referring now to FIG. 1, the decorative urn shown includes a base section 11 having an upper section 12 placed thereon. A wick assembly 14 is centrally located in the housing or upper section. The wick 15 is shown protruding therefrom. A peripheral rim 16. extends about the outer edge of the upper surface of section 12. In the embodiment shown, the base section 11 and the upper section 12 are formed of machined nylon to have the same diameter. Alternatively, the sections may be formed by a molding processes.

The sections comprising the urn have light-transmissive characteristics. As a result, when the wick 15 is lighted and a flame is present in the central region of the upper section 12, the light is transmitted throughout the decorative urn. The light is brightest in the peripheral rim of the upper section and reduces in intensity in the vertical direction away from the flame. In the preferred embodiment both sections are formed of light-transmissive material, although the base section 11 may be formed by machining brass or bronze.

Figure 3:
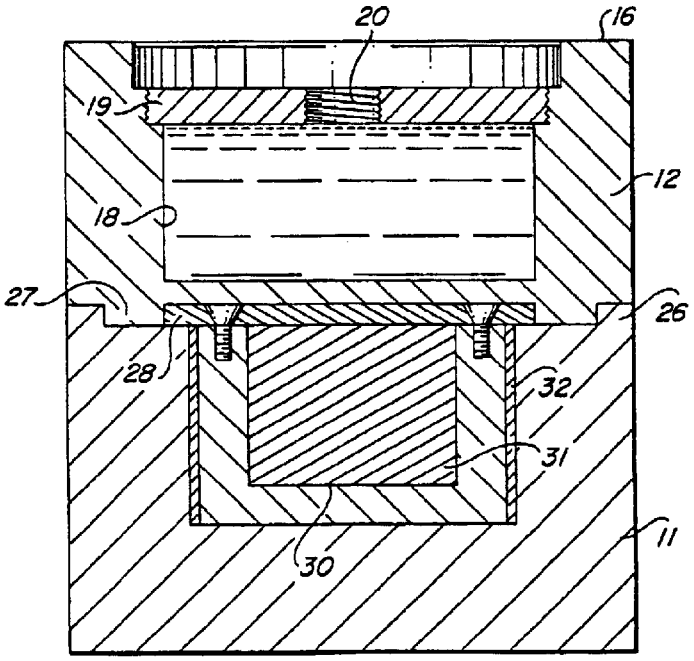
FIG. 3 is a cross sectional view of the embodiment of FIG. 1 with the wick assembly omitted.

The upper section 12 is readily detached from the base section 11 as shown in FIG. 3. The upper section contains a fuel reservoir 18 which is bounded by a mating threaded lid 19. The lid is provided with a threaded opening 20 therein for receiving the wick assembly. The wick assembly 14 includes a wick holder 22, typically formed of brass, that is threadably inserted into a machined nylon support 21. The support has a downwardly extending threaded engaging end 24 with a central passageway therein for the wick to descend into fluid reservoir 18. The particular embodiment shown has a large fluid reservoir to permit the wick to carry a flame for months at a time without refilling.

As shown, the base section 11 has a peripheral flange 26 which receives a mating downwardly extending flange 27 to allow the nesting of the upper section 12 upon the base section 11. As shown in FIG. 3, the central cavity 30 contained in the base section is shown having a receptacle 31 located therein. The receptacle 31 is the container for the stored ashes and is held in position by lid 28. In the preferred embodiment, the lid is oversize so that the edges thereof extend beyond the edge of cavity 30. As mentioned, the device is made of light-transmissive material. However, the outline of the receptacle containing the ashes need not be directly viewed by the observer. The opaque shield 32 is positioned in slots machined into the base section segments and can be located as desired about the receptacle. If desired, the base section can be non light transmissive.

The uniform surface of the embodiment shown in FIG. 1 is especially well suited to the mounting of informational plaques containing reference material as desired. Further, the upper section can be removed and used independently as a source of light. In this situation, the base section can be utilized for the relocation of the ashes without removal of the receptacle. As shown, the receptacle is bounded by the secure nylon base section with the overlying lid 28 affixed thereto. This provides a permanent envelope for internment.

While the above description has been with reference to a particular embodiment of the invention, it is to be noted modifications and variations may be made therein without departing from the scope of the invention as claimed.

What is claimed is:

1. A decorative urn for storing cremation ashes, said urn comprising:

a) a base section having a top surface, said base section having a cavity for receiving a receptacle therein for storing the cremation ashes;

b) a housing having a fluid reservoir therein;

c) engaging means for removably supporting the housing on the top surface of the base section;

d) a centrally-located port formed in said housing, said port communicating with the fluid reservoir;

e) a wick assembly removably located in said port and communicating with the fluid reservoir, said assembly adapted to receive a wick therein for drawing fuel from the reservoir and sustaining a lighted flame.

2. The decorative urn of claim 1 wherein said housing is formed of light-transmissive material.

3. The decorative urn of claim 2 further comprising a lid for affixation to the base section, said lid being dimensioned to overlie the cavity.

4. The decorative urn of claim 3 further comprising an opaque shield bounding said cavity.

5. The decorative urn of claim 4 further comprising said receptacle dimensioned to be received in said cavity.

* * * * *